US005243746A

United States Patent [19]

Shinichi

[11] Patent Number: 5,243,746

[45] Date of Patent: Sep. 14, 1993

[54] METHOD FOR MANUFACTURING COIL SPRINGS

[75] Inventor: Sanukiya Shinichi, Chiba, Japan

[73] Assignee: Tokyo Coiling Machine Co., Ltd., Chiba, Japan

[21] Appl. No.: 953,550

[22] Filed: Sep. 29, 1992

[30] Foreign Application Priority Data

Nov. 18, 1991 [JP] Japan ..... 3-329485

[51] Int. Cl.[5] ..... B21F 35/00

[52] U.S. Cl. ..... 29/173; 72/138; 140/103

[58] Field of Search ..... 29/173; 72/138, 10, 72/14; 140/103

[56] References Cited

U.S. PATENT DOCUMENTS

| | | | |
|---|---|---|---|
| 3,427,838 | 2/1969 | Rimmer | 72/138 |
| 4,112,721 | 9/1978 | Takase et al. | 72/138 |
| 4,991,277 | 2/1991 | Itaya | 29/173 |

*Primary Examiner*—P. W. Echols

*Attorney, Agent, or Firm*—Koda and Androlia

[57] ABSTRACT

A method of manufacturing coil springs being performed by giving priority to the free length of coil springs with a feature that the length of wire material used for forming initial- and main-coiling sections and an end coiling section of a single coil spring is measured and checked if the used wire material is within a predetermined length so that the resulted coil springs have a high rate of satisfactory products with a high level of precision.

2 Claims, 3 Drawing Sheets

METHOD FOR MANUFACTURING COIL SPRINGS

BACKGROUND OF THE INVENTION

1. Field of the Invention

The present invention relates to a method for manufacturing a coil spring which has a predetermined free length and also has a desirable elasticity.

2. Prior Art

Conventionally, as shown in FIG. 4, coil springs are manufactured using a coiling pin 1, a pitch tool 2, etc. incorporated in a coil fabricating apparatus.

A wire material W, which is formed into a coil spring, is passed through a wire guide 3 and fed out by being sandwiched between a pair of feed rollers 4 and 5. The wire material W is further passed through wire guides 6 and 6a and is caused to contact the coiling pin 1 so that the wire material W is shifted onto a core piece 7.

The wire material W is thus formed into a helical shape of a prescribed pitch by the pitch tool 2. The helical shaped wire material W is then cut by a cutting tool 8 into a coil spring.

Generally, coil springs are required to have a predetermined free length and a desirable performance; and it is particularly necessary that a predetermined free length, which is the total length of a coil spring, is constant for each and every coil spring manufactured.

Conventionally, a single coil spring is manufactured by feeding a wire material which has a length that is necessary to fabricate a single coil spring, and then the free length of the completed coil spring is measured by a contact or non-contact type sensor. The free length is compared with a predetermined set-length, and coil springs which are longer or shorter than the reference length are discarded as defective products. If the defective products exceed a certain number, a motor which adjusts the pitch tool 2 is actuated so as to finely adjust the pitch, thus insuring that subsequent coil springs will have the predetermined free length.

Usually, the free length of a coil spring is affected by the characteristics of the wire material itself and by the variation in the wire habit, tensile force, etc. of the wire material. Thus, some coil fabricating apparatuses take such factors into consideration in order to manufacture coils which have a predetermined free length.

However, in these systems, since the free length of the finished coil spring is checked after the completion of wire fabrication to find satisfactory and defective springs, there still are problems. In particular, the coil springs are measured, after being made, for its free length, but obviously the finished springs cannot be modified. In addition, the wire material includes factors (such as wire habit, etc.) which can be altered during the process of wire pulling which is one of the steps of coil spring manufacturing. Such factors can greatly affect the resulted springs. Accordingly, even if the wire material has a predetermined length, the free length of the coil spring can vary and does not sustain consistency.

Furthermore, in the systems which take the wire material characteristics and the variations in wire habit, tensile force, etc. into account, such elements are brought into the tool set-up process or into the reference values input process, which are performed in the initial stage of coil manufacturing. If the material factors change during the manufacturing process, since the initial set-ups as described above cannot be altered in response to these changes, the number of defective products tends to be high when the systems where the free length is measured after the completion of coiling is utilized. In particular, when an attempt is made to produce coil springs with a highly precise free length, the rate of satisfactory products tends to drop.

SUMMARY OF THE INVENTION

The object of the present invention is to solve the prior art problems described above. In particular, the present invention provides a method which makes it possible to manufacture coil springs with a high rate of satisfactory production and with the precision of the free length of the coil springs kept at a high level.

The method of manufacturing coil springs provided by the present invention is characterized in that coil springs are manufactured with priority given to the free length of the coil springs. More specifically, when the coil spring in the process of manufacturing reaches a length which is equal to a predetermined entire length for the coil spring minus the length of the end coiling section, this length is detected by a sensor. A pitch tool is operated on the basis of this detection signal so as to start the formation of the end-coiling section. When the formation of the end-coiling section is completed, the coil spring is cut by a cutting tool, and at the same time, the length of the wire material used for the finished coil spring is measured. Then, a check is made to see whether or not this length is within a predetermined range.

Thus, in each of the coil springs manufactured by the method of the present invention, the length of the initial and main sections of the spring will always be the same for every spring, and the end-coiling section of a predetermined length is added thereto. The lengths of the initial-coiling section and the end-coiling section are very short and more or less constant, and such lengths do not affect to the overall free length of the spring. Accordingly, the precision of the free length of the coil spring manufactured by the method of the present invention can be extremely high. Furthermore, since the length of the wire material which is turned into a coil spring is kept within a fixed range, a desired spring performance is secured for every spring.

DETAILED DESCRIPTION OF THE INVENTION

An embodiment of the present invention will be described with reference to the accompanying drawings.

Figure 1:
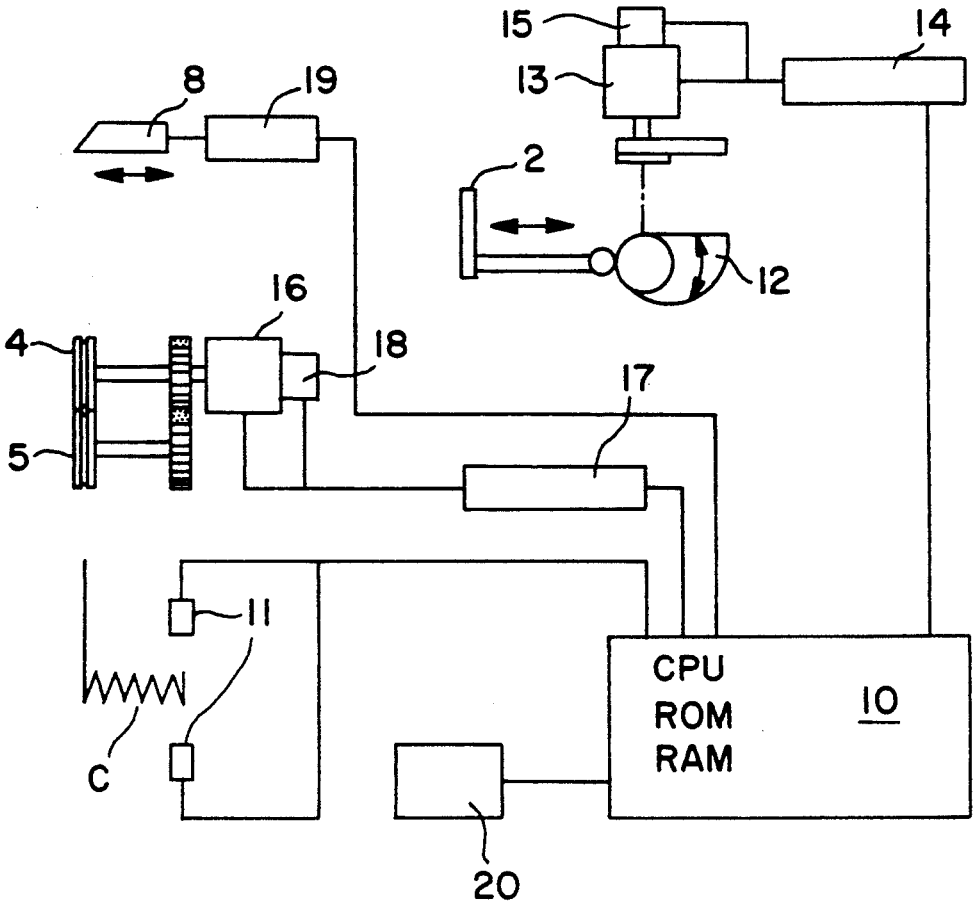
FIG. 1 is a schematic diagram which illustrates the relationship (in model form) of the main parts of an apparatus which uses the coil spring manufacturing method of the present invention.
Figure 2:
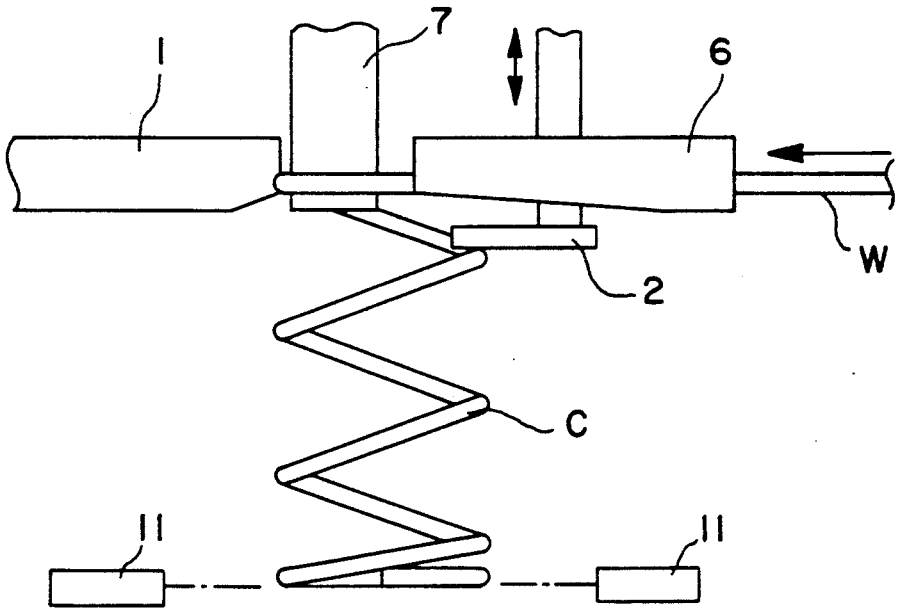
FIG. 2 is an enlarged top view which shows the main section of the a of FIG. 1.
Figure 4:
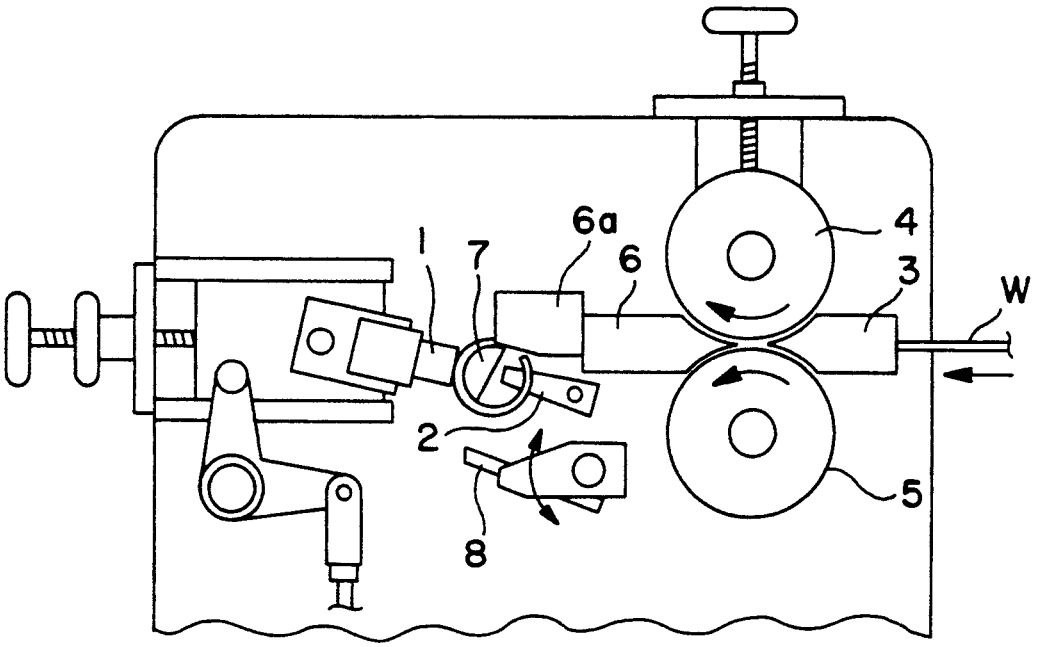
FIG. 4 PRIOR ART
FIG. 4 is a schematic side view of a prior art apparatus for manufacturing coil springs.

FIGS. 1 and 2 illustrate (in schematic form) one example of an apparatus which uses the method of the present invention. This coil fabricating apparatus, like the prior art apparatus shown in FIG. 4, is equipped with a coiling pin 1 which forms the wire material W into a bent shape (or a coil spring) and determines the external diameter of the coil spring. A pitch tool 2 which determines the pitch of a coil spring C, a pair of wire material feed rollers 4 and 5, a cutting tool 8, etc. are also incorporated in the apparatus.

The coil fabricating apparatus of the present invention further includes a control unit 10 (as a motion controller) which includes a CPU (microcomputer) that controls the pitch tool 2, the feed rollers 4 and 5, etc. as shown in FIG. 1.

Furthermore, as shown in FIG. 2, the apparatus further includes detectors 11 which detect the length of the coil spring C being manufactured. The detectors detect the length that is equal to a predetermined free length of the coil spring minus the length of the end-coiling section. A laser sensor or an optical sensor is used as the detector, and a proximity switch, etc. could also be used.

The pitch tool 2 is adjusted by a first servo motor 13 via an appropriate transmission mechanism, e.g., a cam mechanism 12, as shown in FIG. 1. The first servo motor 13 is connected to the control unit 10 via a first drive unit 14, so that the pitch tool 2 is actuated by signals from the control unit 10. A rotary encoder 15 is mounted to the first servo motor 13. The encoder 15 inputs pulse signals, which correspond to the amount of movement of the pitch tool 2, into the control unit 10.

The feed rollers 4 and 5 feed the wire material W to the coiling pin 1. It is designed so as to prevent slippage between the wire material W and the rollers 4 and 5. The rollers 4 and 5 are commonly driven by a second servo motor 16 via gears, etc. The second servo motor 16 is connected to the control unit 10 via a second drive unit 17. The reference numeral 18 is a rotary encoder which is also mounted to the second servo motor 16.

Thus, the rollers 4 and 5 are actuated by command signals from the control unit 10, and the rotation of the rollers, in other words, the amount of feed of the wire material W, is inputted into the control unit 10.

A piston-cylinder 19 which acts as a driving means for a reciprocating motion of the cutting tool 8 is also connected to the control unit 10. The reference numeral 20 refers to a selecting device which selects satisfactory coil springs in accordance with commands from the control unit 10.

Figure 3:
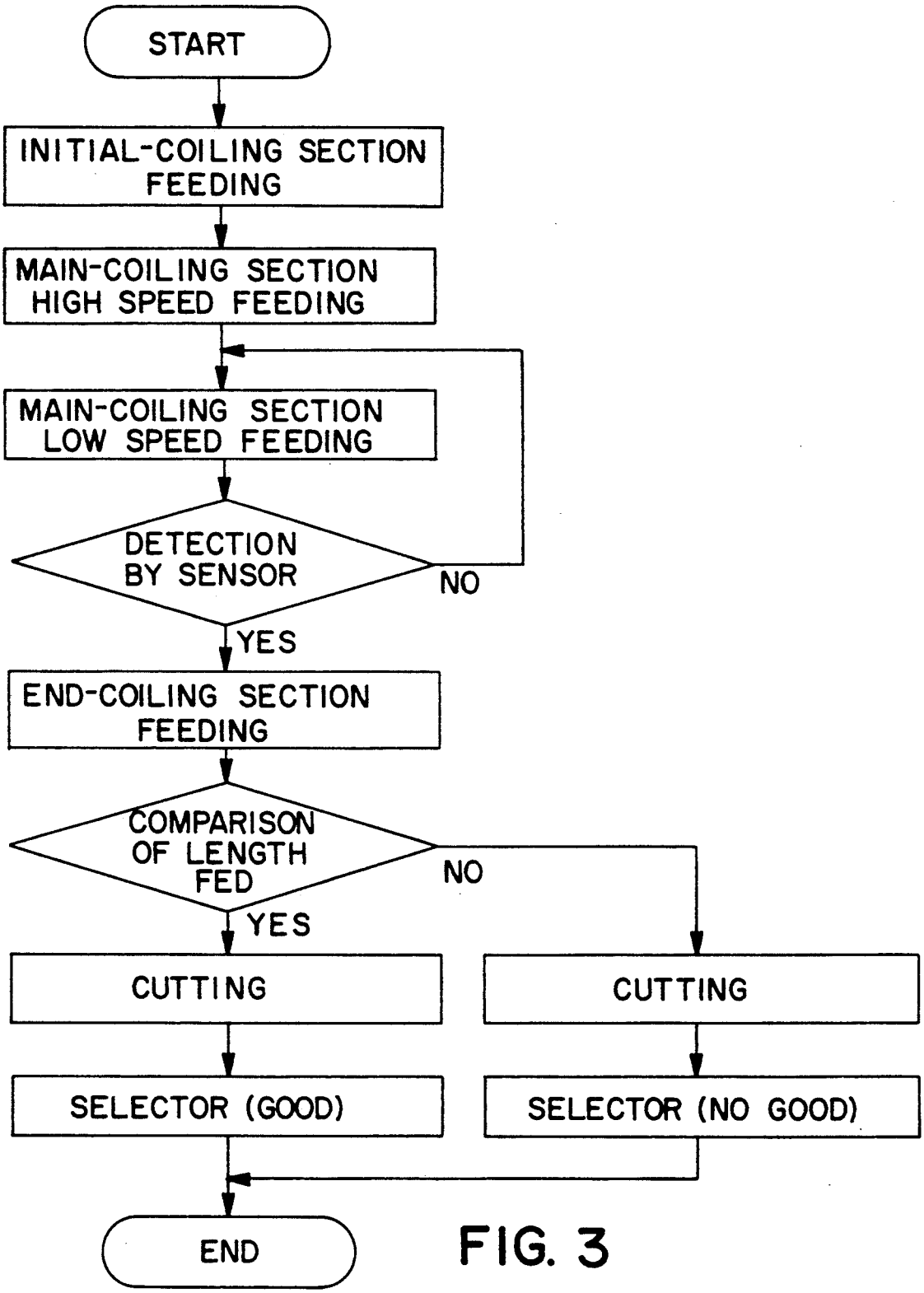
FIG. 3 is a flow chart showing the steps of the manufacturing method of the present invention.

FIG. 3 is a flow chart of the coil spring manufacturing method of the present invention.

The wire material W is first fed by the feed rollers 4 and 5 so that the initial-coiling section and the main-coiling section (that is an effective coil part), which follows the initial-coiling section, are formed. When it is sensed, based upon the length of the wire material fed out, that the forward end of the coiled spring approaches a position where the coil spring is detected by the detector 11, the feeding speed of the wire material is slowed down; then, when the coil spring is detected by the detector 11, the resulting detection signal is inputted into the control unit 10, and the first servo motor 13 is actuated via the first drive unit 14 so that the pitch tool 2 is moved (upward in FIG. 2), thus starting the formation of the end-coiling section.

The position of the detection performed by the detectors 11 is set so as to be equal to the predetermined free length of the coil spring minus the length of the end-coiling section. Accordingly, the position of the detector 11 is always constant or remains unchanged; as a result, the free length of the manufactured springs is constant. The end-coiling section is formed so as to have a preset length, and when the formation of the end-coiling section is completed, the cutting tool 8 is actuated by the driving action of the cylinder 19 so that the wire material is cut at the position of the core piece 7. One cycle of the wire manufacturing process is thus completed.

When one cycle of the coil spring manufacturing is thus completed, the amount of wire material fed out during the one cycle span, i.e., the length of the wire material used in the coil spring, is calculated based upon the angle of rotation of the second servo motor 16 that drives the feed rollers 4 and 5. The value thus obtained is inputted into the control unit 10 via the rotary encoder 18. In the control unit, this value is compared with a preset reference wire length. If the difference between the two lengths is permissible, the finished coil spring is sent to a "satisfactory product" line by the selecting device 20; if the difference is not within the permissible range, the finished coil spring is sent to a "defective product" line.

The permissible difference in the length of the wire material varies depending upon the free length, pitch, number of coils wire diameter and conditions of use, etc. and is determined in accordance with these elements.

In the method of the present invention, the formation of the end-coiling section starts when the position of the end of the pitched coil (or main-coiling section) is detected. Accordingly, the free length of the spring can always be the same as the one set beforehand. Since the length of the end-coiling section is set at a fixed value, and since this value is extremely small compared to the free length of the coil spring, the end-coiling section does not affect the free length of the spring. Accordingly, the precision of the free length of the spring can be kept high.

If a permissible limit is, for example, 0.01 (or$\Delta L/L=0.01$) for a coil spring which has a 30 mm free length, almost 100% of the coil springs produced by the method of the present invention fall within the permissible and satisfactory range.

According to the present invention, the coil springs are manufactured with priority given to their free length, and a check is made to see whether or not the wire material length for each coil spring is within a permissible limit. Also, in the present invention, if the wire material length, which affects the performance of the coil springs, for the individual coil spring is different, and if the wire material length is not within the permissible limit, then the pitch tool is immediately fine-adjusted by the control unit so as to correct the problem. In some cases, the correction is made manually after stopping the apparatus. In most cases, the setting of the permissible limit for the wire material length is determined by permissible values of performance of coil spring, but no particular problems are encountered as long as an permissible value is applied.

In the present invention, as described above, defective products are removed in accordance with the length of the used wire material. Also, a prescribed amount of wire material is used for each coil spring, and an error, if any, in the free length of each coil spring would only come from errors in the length of the end-coiling section which can be disregarded in view of coil characteristics. As a result, the precision of the free length of the fabricated coil spring is extremely high, and a desired spring performance is assured. Thus, the required precision of the free length of the coil springs can be kept at a high level, and such satisfactory coil springs can be manufactured at a high rate.

I claim:

1. A method for manufacturing a coil spring having a predetermined length, said method comprising the steps of:

detecting a point in a coil manufacturing process where a length of said coil spring being made reaches a length which is equal to a predetermined free length of a coil spring minus the length of an end-coiling section;

forming an end-coiling section based upon the thus obtained detection signal;

cutting said spring when the forming of said end-coiling section is finished;

measuring the used wire material length for said coil spring; and checking to see whether or not said wire material length is within a predetermined range.

2. A method for manufacturing a coil spring comprising the steps of:

forming an initial-coiling section of said coil spring by coiling a wire;

forming a main-coiling section following said initial-coiling section by coiling said wire with a predetermined pitch;

detecting lengths of said initial-coil section and said main-coiling section by detectors, said lengths being equal to a total length of a coil spring to be made minus a length of and end-coiling section;

forming an end-coiling section at the end of said main-coiling section in response to signals obtained by said detection;

cutting said spring after forming said end-coiling section;

measuring the length of said wire used for said coil spring; and checking to see whether or not said length of used wire is within a predetermined range.

* * * * *